US007284556B2

(12) United States Patent
Chou

(10) Patent No.: US 7,284,556 B2
(45) Date of Patent: Oct. 23, 2007

(54) CLEANING-TISSUE COMB

(76) Inventor: Chuan Chou, 2F., No.337, Songlong Rd., Sinyi District, Taipei City 110 (TW)

( * ) Notice: Subject to any disclaimer, the term of this patent is extended or adjusted under 35 U.S.C. 154(b) by 0 days.

(21) Appl. No.: 11/328,117

(22) Filed: Jan. 10, 2006

(65) Prior Publication Data

US 2007/0157943 A1 Jul. 12, 2007

(51) Int. Cl.
*A45D 24/42* (2006.01)
*A46B 9/04* (2006.01)

(52) U.S. Cl. ..... 132/119; 15/169

(58) Field of Classification Search ..... 132/119, 132/123, 125; 15/169, 160, 206, 246; 119/628
See application file for complete search history.

(56) References Cited

U.S. PATENT DOCUMENTS 4,137,596 A * 2/1979 Carlson et al. ..... 15/203
4,517,703 A * 5/1985 Koke ..... 15/246
6,021,542 A * 2/2000 Norman ..... 15/169
6,595,219 B2 * 7/2003 Anderson ..... 132/123

* cited by examiner

*Primary Examiner*—Robyn Doan
(74) *Attorney, Agent, or Firm*—Troxell Law Office, PLLC

(57) ABSTRACT

The present invention is a comb, whose staples can be easily kept clean by ripping a tissue on a base of staples.

5 Claims, 8 Drawing Sheets

CLEANING-TISSUE COMB

FIELD OF THE INVENTION

The present invention relates to a comb; more particularly, relates to cleaning staples seat of the comb easily with a cleaning tissue.

DESCRIPTION OF THE RELATED ART

A comb is a general tool used for grooming oneself, which comprises a handle and a staples seat; and the staples seat has a plurality of staples for smoothening hair with an equal distance between every two adjacent staples.

After a period of time of use, hair is left among staples so that the hygiene of the comb becomes bad. In the early days, the hair among the staples is cleaned with fingers or a thin-and-long tool to keep the comb clean. Yet, both ways require repeated actions for removing the hair and so are not convenient.

To solve the above problem, a prior art, "A hair-comb having a fur frame", is proclaimed in Taiwan. As shown in FIG.7, the prior art has an elliptic frame 4 with a danse fur 41. When the elliptic frame 4 is integrated with a staples seat 5 of a hair-comb, the fur 41 are cove red on the staples seat 5. And the elliptic frame 4 can be taken out and even be bended into a brush for cleaning the fur 41. Yet, because the fur 41 is not danse enough and only an end of the fur 41 is fixed on the elliptic frame 4, hair left on the hair-comb can not be removed totally by the fur 41; and the hair-comb itself is not so convenient in use either. Hence, the prior art does not fulfill users' requests on actual use.

SUMMARY OF THE INVENTION

The main purpose of the present invention is to remove hair together with odds and ends on a staples seat of a comb.

The secondary purpose is to provide the comb with a cleaning tissue which is easily positioned and deposed on the staples seat, where the staples seat is easily kept clean by using the cleaning tissue.

To achieve the above purposes, the present invention is a cleaning-tissue comb, comprising a comb body; a staples seat having a plurality of staples; and a stack of cleaning tissues having punch holes cooresponding to the staples, where the staples move to and fro to be directed at and to penetrate through the punch holes for deposing the cleaning tissues in the staples seat; the staples together with the cleaning tissues are put into the comb body; and, after a period of time of use, hair together with odds and ends on the staples seat is removed by ripping one of the cleaning tissues on top surface to keep the staples seat clean. Accordingly, a novel cleaning-tissue comb is obtained.

BRIEF DESCRIPTIONS OF THE DRAWINGS

The present invention will be better understood from the following detailed description of the preferred embodiment according to the present invention, taken in con junction with the accompanying drawings, in which FIG. 1 is a perspective view showing a comb body of a preferred embodiment according to the present invention;

DESCRIPTION OF THE PREFERRED EMBODIMENT

The following description of the preferred embodiment is provided to understand the features and the structures of the present invention.

Figure 1:
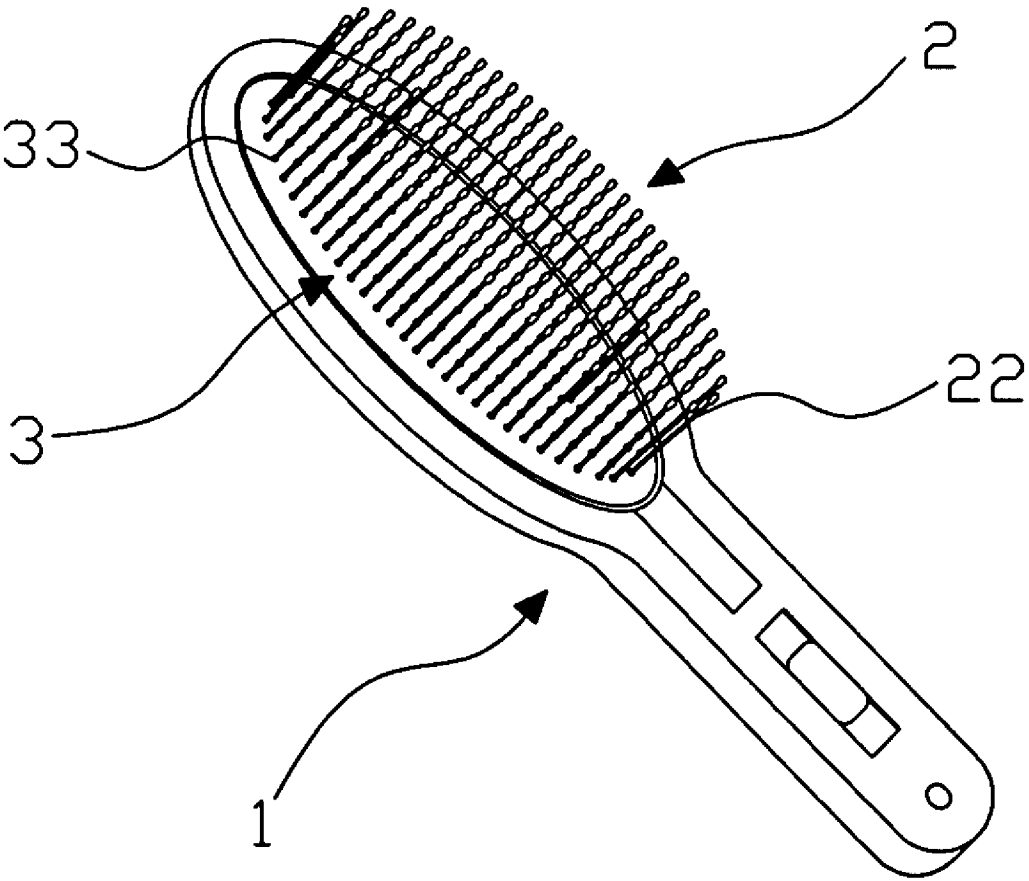
Figure 2:
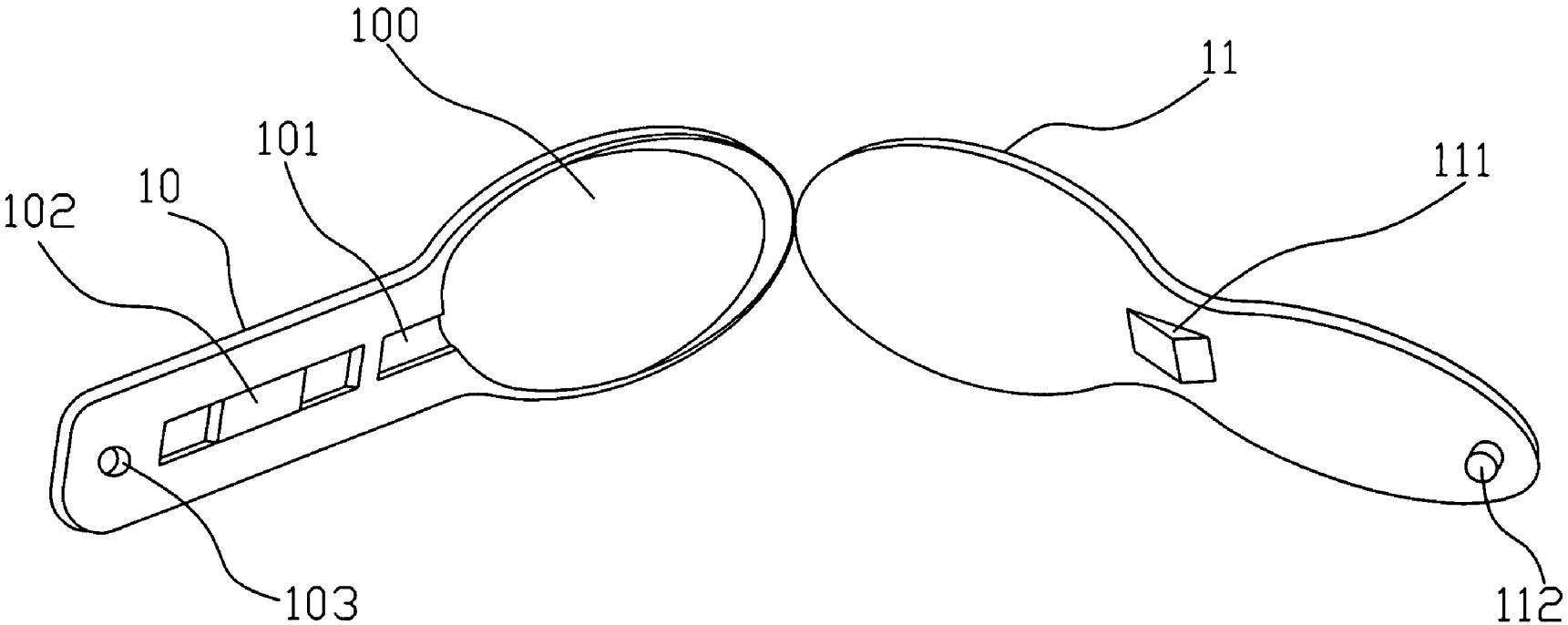
FIG. 2 is an explosive view showing the comb body of the preferred embodiment according to the present invention.

Please refer to FIG. 1, which is a perspective view showing a comb body of a preferred embodiment according to the present invention. As shown in the figure, the present invention is a cleaning-tissue comb, comprising a comb body 1; a staples seat 2 having a plurality of staples 22; and a stack of cleaning tissues 3 having punch holes 31 corresponding to the staples seat 2. Please further refer to FIG. 2, which is an explosive views showing the comb body of the preferred embodiment according to the present invention. As shown in the figure, the comb body 1 comprises a front board 10 and a back board 11 connected together by using a pivot at the same ends so that the comb body 1 can be opened and closed repeatedly with the front board 10 and the back board 11. A hollow 100 is located at an end of the front board 10; and a guiding hole 103 is located at another end. The hollow 100 has a hem on a surface; and an end of the hollow 100 is connected to an opening 101 of the front board 10. And, a slider 102 is movably deposed in the opening 101 of the front board 10. In the other hand, a protruding part 111 is deposed at the middle of the back board 11; and a guiding fastener 112 is deposed at an end of the back board 11 for fixing with the guiding hole 103 of the front board 10.

Figure 3A:
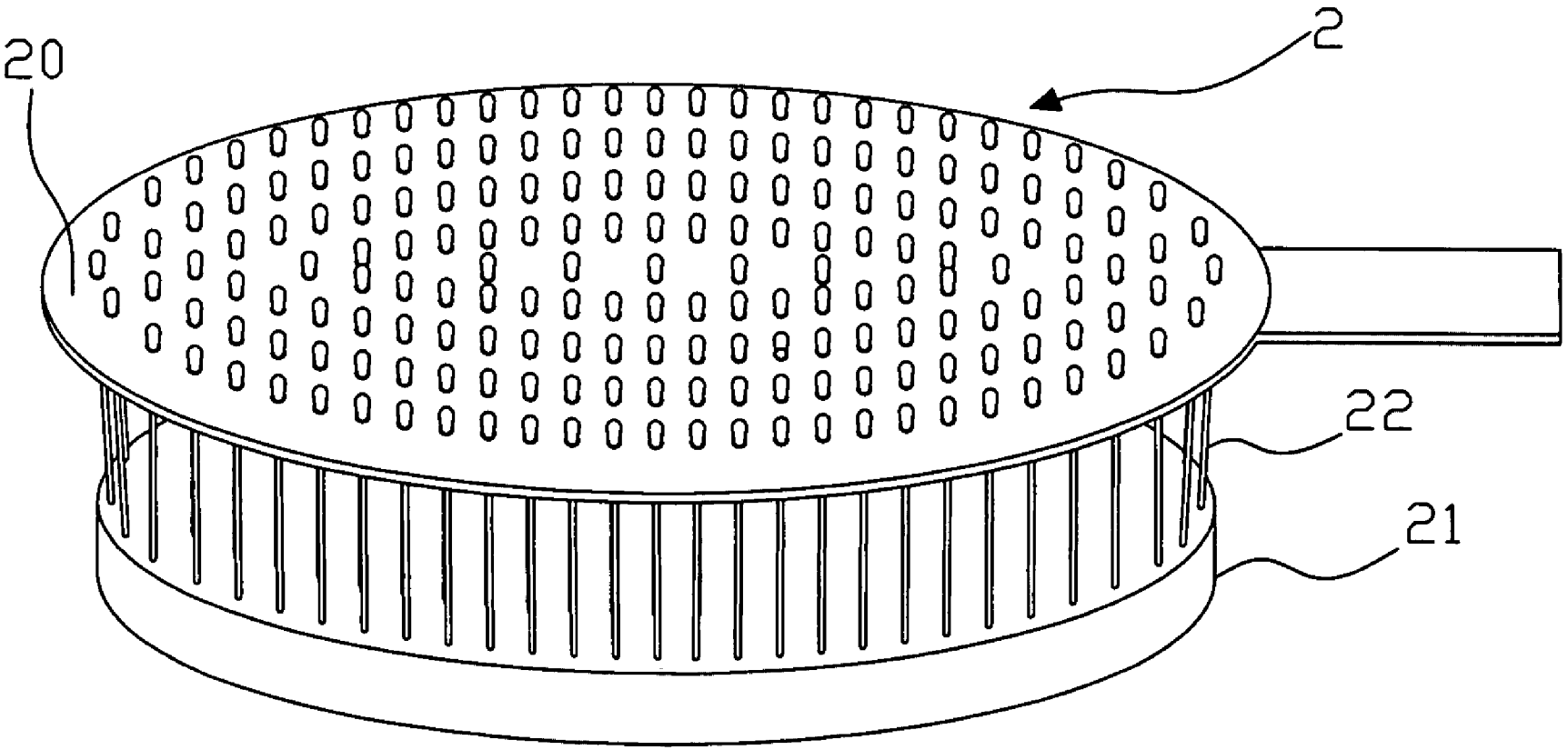
FIG. 3A is an explosive view showing a staples seat of the preferred embodiment according to the present invention.
Figure 3B:
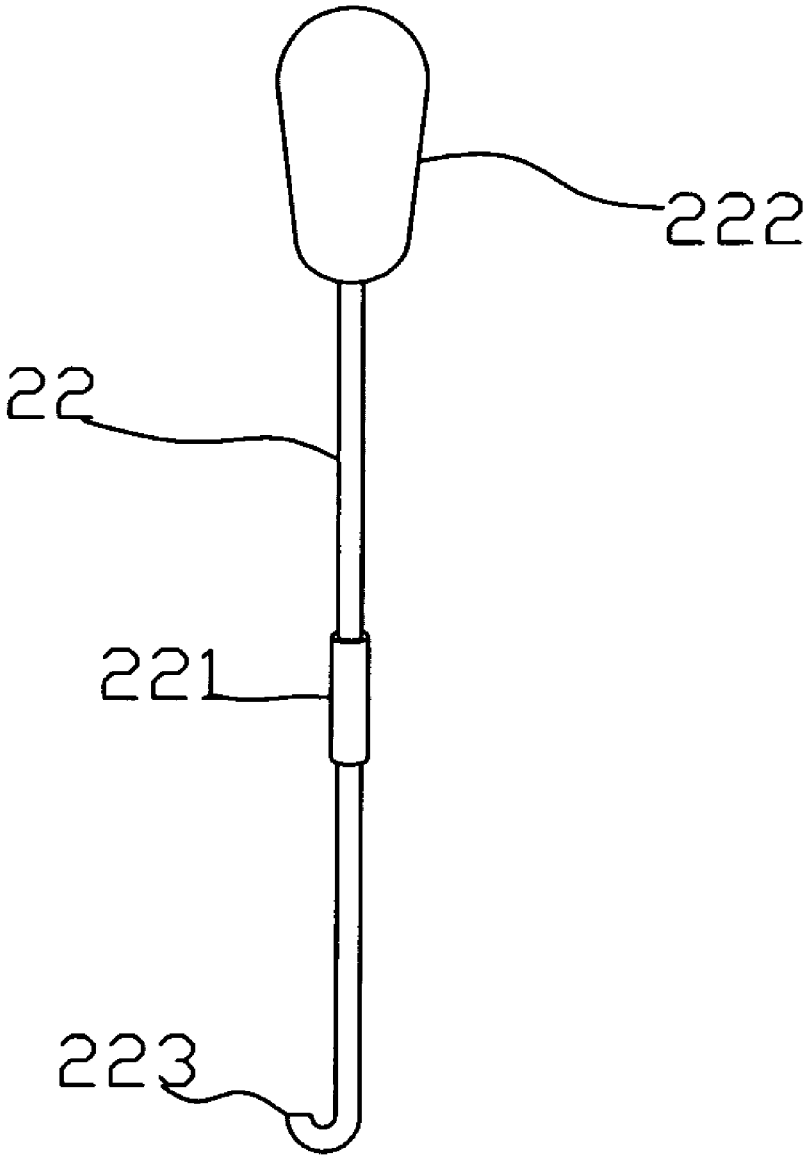
FIG. 3B is an enlarged view showing a staple of the preferred embodiment according to the present invention.

Please refer to FIG. 3A and FIG. 3B, which are an explosive view showing a staples seat and an enlarged view showing a staple according to the preferred embodiment of the present invention. As shown in the figures, a staples seat 2 is deposed cooresponding to a hollow 110 of a front board 10, comprising a top layer 20, a bottom layer 21 and a plurality of staples 22. The top layer 20 and the bottom layer 21 has a plurality of holes which are positioned corresponding to the staples 22. Each staple 22 is movably penetrates through a short sleeve 221 and has a cap 222 covering a head of the staple 22 at an end and has a hook 223 at the other end. Every staple 22 penetrates through one of the holes of the top layer 20 to be fixed with the short sleeve 221; the staple 22 is fixed to one of the holes of the bottom layer 21 with the hook 223; the cap 222 of the staple 22 is exposed above the top layer 20; thus, the assembling of the staples seat is done. Besides, after fixing the top layer 20, the bottom layer 21 moves to and fro through sliding the short sleeve 221 on the staple 22.

Figure 4:
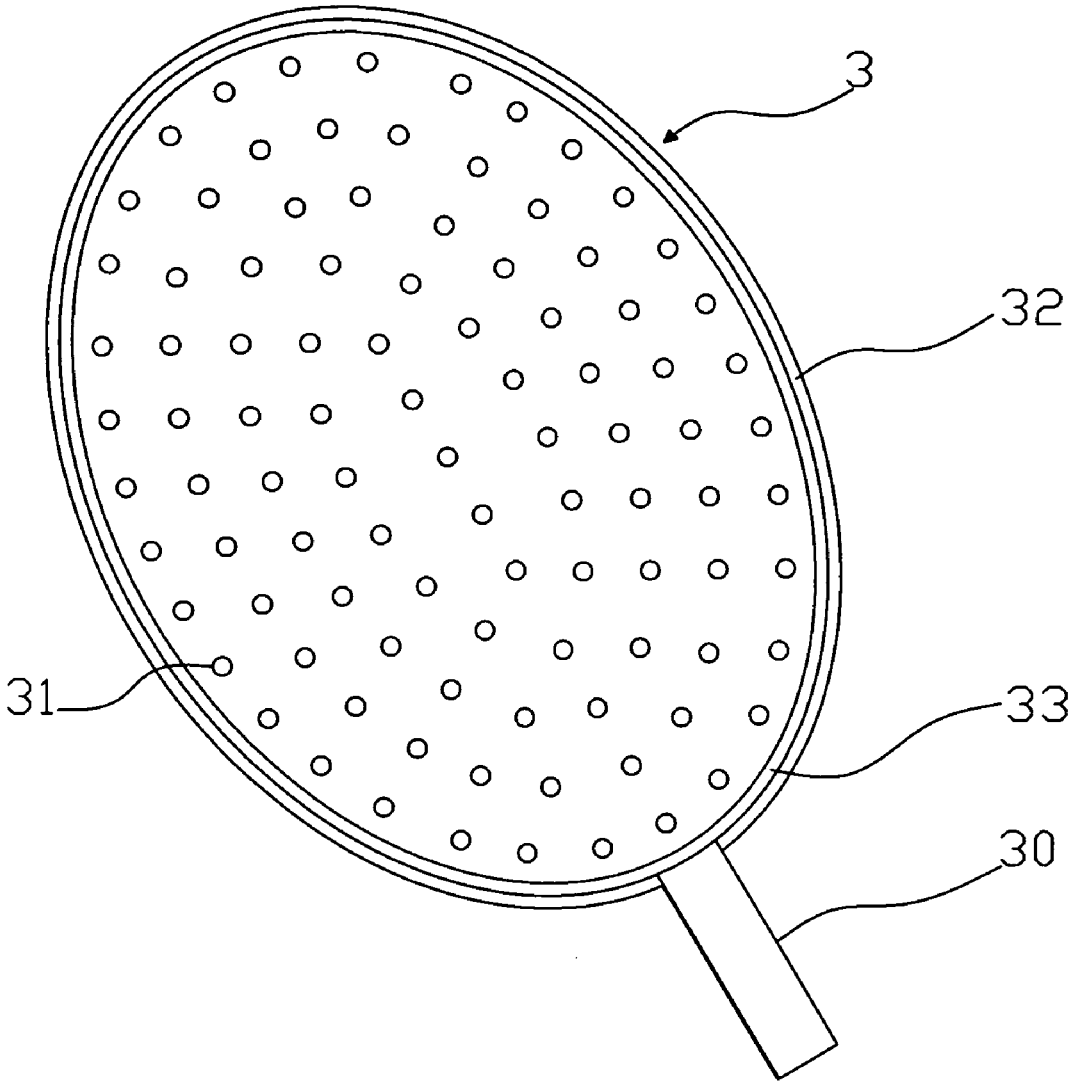
FIG. 4 is a view showing a cleaning tissue of the preferred embodiment according to the present invention.

Please refer to FIG. 4, which is a view showing a cleaning tissue of the preferred embodiment according to the present invention. As shown in the figure, a stack of cleaning tissues 3 each with a ripping part 30 at the same end is deposed cooresponding to a hollow 100 of a front board 10. The cleaning tissue 3 has an outer circling part 32 and an inner circling part 33. The outer circling part 32 is fixed at an inner hem of a slot of the comb body 1; and the inner circling part 33 is to be ripped with the ripping part 30. And, the cleaning tissue 3 has punch holes 31 positioned corresponding to the staples 22 of the staples seat 2.

Figure 5:
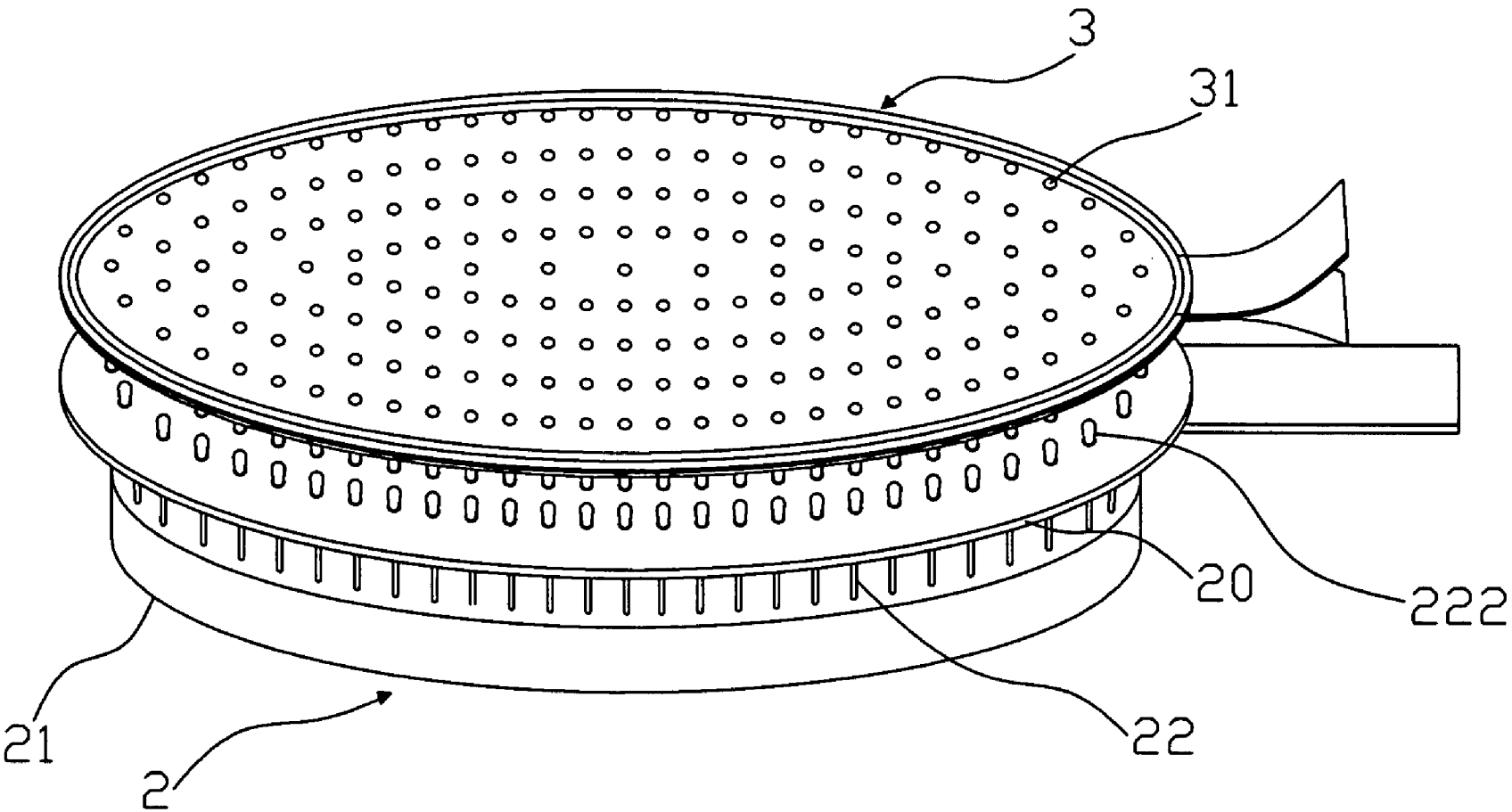
FIG. 5 is a view showing a state of use of the cleaning tissues on the staples seat of the preferred embodiment according to the present invention.

Please refer to FIG. 5, which is a view showing a state of use of cleaning tissues on the staples seat of the preferred embodiment according to the present invention. As shown in the figure, in the beginning, a top layer 20 of a staples seat 2 is pulled downward to a bottom layer 21 so that caps 222 are drawn near to the top layer 20.

In the mean time, the caps 222 slip through the punch holes 31 of the cleaning tissue 3; and the bottom layer 21 is pushed upward to make the staples 22 penetrate through the cleaning tissues 3. Then, please further refer to FIG. 2, the staples seat 2 together with the stack of cleaning tissues 3 is put into the hollow 100 of the front board 10 while the ripping parts 30 of the cleaning tissues 3 are put in to an opening 101 of the front board 10. Finally, a guiding fastener 112 of the back board 11 is fastened to a guiding hole 103 of the front board 10. Thus, a novel cleaning-tissue comb is obtained.

Figure 6:
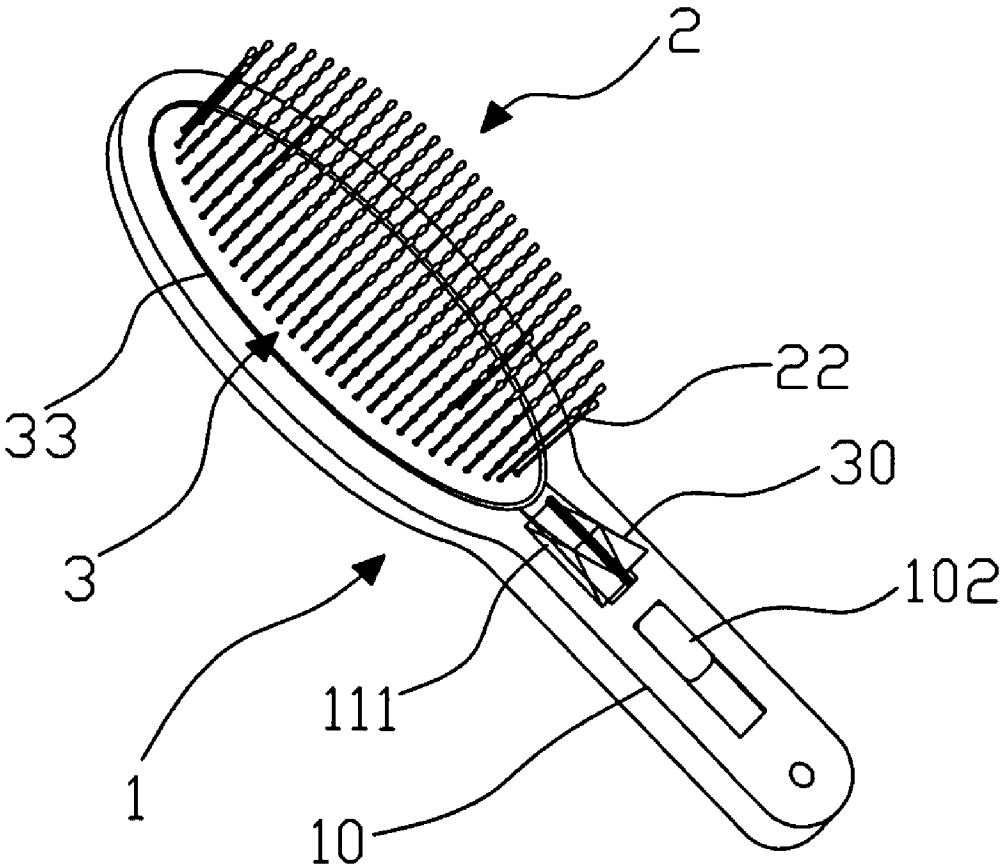
FIG. 6 is a view showing a state of use of the preferred embodiment according to the present invention.
Figure 7:
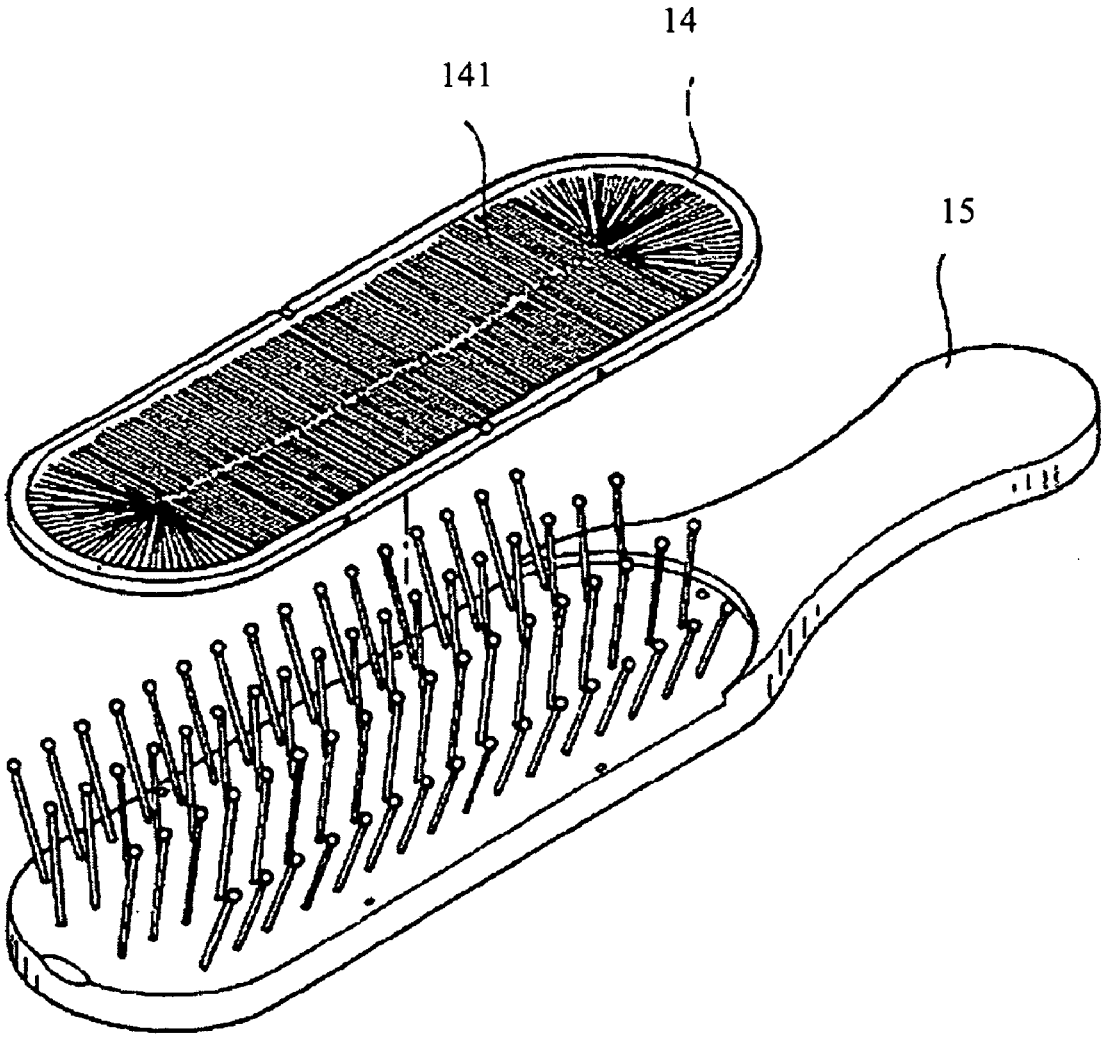
FIG. 7 (Prior Art)
FIG. 7 is an explosive view of a prior art.

Please refer to FIG. 6, which is a view showing a state of use of the preferred embodiment according to the present invention. As shown in the figure, after a period of time of use, some hair is left among staples 22 on the upmost cleaning tissue 3. A slider 102 of the front board 10 is pushed to move a protruding part 111 butted against the ripping part 30 of the cleaning tissue 3. As the slider 102 is further moved, the ripping part 30 is lifted by the protruding part 111 so that the cleaning tissue 3 is to be ripped along the inner circling part 33 by the ripping part 30. And, along with the tearing off of the cleaning tissue 3, the hair among the staples 22 together with odds and ends on the cleaning tissue 3 is removed so that the staples seat 2 is kept clean.

As a result, the present invention has the following advantages:

1. The cleaning tissues 3 are easily set on the staples seat 2 through the staples 22 which is movable to and fro by using a short sleeve 221 penetrated through.

2. The cleaning tissue 3 is to be easily ripped by a ripping part 30 as the slider 102 of the front board of the comb body 1 slides, where the staples seat 2 is so kept clean.

To sum up, the present invention is a cleaning-tissue comb, where hair together with other odds and ends among staples is easily removed by ripping a cleaning tissue to keep a staples seat clean.

The preferred embodiment herein disclosed is not intended to unnecessarily limit the scope of the invention. Therefore, simple modifications or variations belonging to the equivalent of the scope of the claims and the instructions disclosed here in for a patent are all within the scope of the present invention.

What is claimed is:

1. A cleaning-tissue comb, comprising:

(a) a comb body opening and closing repeatedly;

(b) a staples seat having a plurality of staples; and (c) a cleaning tissue stacked up on said staples seat, wherein said cleaning tissue has a plurality of punch holes corresponding to said plurality of staples;

wherein said plurality of staples penetrate through said plurality of punch holes to deposing said cleaning tissue in said staples seat; and wherein said plurality of staples together with said cleaning tissue is located in said comb body to keep said staples seat clean by ripping said cleaning tissue, wherein said comb body comprises a front board and a back board fastened together at an end of said comb body, wherein said back board has a protruding part deposed on a middle of said back board and has a guiding fastener at an end of said back board, said protruding part abutting a ripping part of said cleaning tissue, wherein a hollow is located at an end of said front board and a guiding hole is located at another end of said front board, wherein said hollow has an inner hem and connects to an opening at an end of said hollow, and wherein a slider is movably deposed in said opening, said slider being configured to be selectively slid to move said protruding part to lift said ripping part of said cleaning tissue.

2. The comb according to claim 1, wherein said comb has a staples seat and said staples seat is desposed corresponding to said hollow of said front board.

3. The comb according to claim 1, wherein said staples seat comprises a top layer, a bottom layer and a plurality of staples; and wherein said top layer and said bottom layer each has a plurality of holes corresponding to said plurality of staples.

4. The comb according to claim 1, wherein each staple is slipped into a short sleeve and has a cap covering an end of said staple and has a hook at another end of said staple.

5. The comb according to claim 1, wherein said cleaning tissue is deposed corresponding to said hollow of a comb body.

* * * * *